US008857610B1

(12) United States Patent
Gruber

(10) Patent No.: US 8,857,610 B1
(45) Date of Patent: Oct. 14, 2014

(54) SELF-STANDING CONTAINER FOR PACKAGING A PRODUCT FOR RETAIL DISPLAY

(75) Inventor: George Paul Gruber, Stillwater, MN (US)

(73) Assignee: Shurtape Technologies, LLC, Hickory, NC (US)

( * ) Notice: Subject to any disclaimer, the term of this patent is extended or adjusted under 35 U.S.C. 154(b) by 187 days.

(21) Appl. No.: 13/525,789

(22) Filed: Jun. 18, 2012

(51) Int. Cl.
*B65D 5/52* (2006.01)

(52) U.S. Cl.
USPC ..... 206/45.24; 206/762; 206/403; 206/515

(58) Field of Classification Search
USPC ..... 206/45.24, 45.2, 45.23, 762, 515, 470, 206/303, 403, 519
See application file for complete search history.

(56) References Cited

U.S. PATENT DOCUMENTS 3,511,288 A * 5/1970 Swett et al. ..... 206/45.2
4,962,849 A * 10/1990 Anderson ..... 206/45.24
5,011,006 A * 4/1991 Anderson ..... 206/45.24
5,363,969 A * 11/1994 Shen ..... 206/581
5,657,874 A * 8/1997 Hustad et al. ..... 206/764
6,401,932 B1 * 6/2002 Weinstein et al. ..... 206/779
6,464,077 B1 * 10/2002 Liu ..... 206/388
7,198,151 B1 * 4/2007 Fomby ..... 206/403
7,624,859 B1 * 12/2009 Casanova et al. ..... 206/45.24
8,083,058 B2 * 12/2011 Marcinkowski et al. ..... 206/352
8,146,745 B2 * 4/2012 Burress et al. ..... 206/462
2007/0163897 A1 * 7/2007 Lee ..... 206/45.24
2007/0187264 A1 * 8/2007 Hofte et al. ..... 206/45.24
2011/0240505 A1 * 10/2011 Hernandez et al. ..... 206/515

* cited by examiner

*Primary Examiner* — Steven A. Reynolds
(74) *Attorney, Agent, or Firm* — Nelson Mullins Riley & Scarborough LLP

(57) ABSTRACT

A container for packaging a product for retail display includes a base defining a product containment area with an annular rim defining an opening into the containment area and a lid mated to the rim for selective attachment to and detachment from the rim for opening and closing access into the containment area. At least one leg, preferably a pair of legs, is connected outwardly to the base adjacent the rim for supporting the assembled base and lid for self-standing on a substantially horizontal retail display surface with the base and the lid in a substantially vertical orientation.

6 Claims, 4 Drawing Sheets

SELF-STANDING CONTAINER FOR PACKAGING A PRODUCT FOR RETAIL DISPLAY

FIELD OF THE INVENTION

The present invention relates generally to containers and, more particularly, to containers for packaging a product for retail display.

BACKGROUND OF THE INVENTION

Products may be packaged for retail sale in a diverse variety of manners: in cartons or boxes, on hangar devices, in plastic shrink-wrapping, or in containers specially configured to the product. For products to be displayed on retail shelves, it is particularly advantageous that product packaging facilitate the self-standing arrangement of the products. However, the configuration of some specially-adapted containers sometimes precludes a standing orientation of such containers, necessitating that they either be stacked, placed on hangers, or other special accommodation be made to display the containers. This is particularly the case with products that may be of a circular or otherwise rounded configuration and are packaged in similarly conforming circular or rounded containers. It is additionally advantageous that container components be configured for compact storage and shipment, in order to minimize shipping costs and space required for inventory storage.

SUMMARY OF THE INVENTION

The present invention seeks to provide a novel form of container adapted for packaging products for retail display, which facilitates self-standing of the container for ease of display on retail shelves, even with a container of a rounded or other configuration without a flat standing package face. The present invention further seeks to provide for convenient nested shipment and storage of the individual components of the container.

Toward these ends, the retail product display of the present invention basically comprises a base defining a product containment area with an annular rim defining an opening into the containment area and a lid mated to the rim for selective attachment to and detachment from the rim for opening and closing access into the containment area. According to the invention, at least one leg is connected outwardly to the base adjacent the rim for supporting the assembled base and lid for self-standing on a substantially horizontal retail display surface with the base and the lid in a substantially vertical orientation.

In a contemplated embodiment of the invention, the base may be bowl-shaped with a bottom wall and an annular wall projecting from the bottom wall, and with the rim formed along a free annular edge of the annular wall. The lid may comprise an inner side formed with an annular flange for frictional engagement about the rim of the base to secure the lid on the base. In a preferred embodiment, the at least one leg may be pivoted to the base adjacent the rim to be engaged and pivoted by the flange of the lid into disposition for supporting the base and lid in the afore-described self-standing orientation when the lid is secured to the base, and the leg may include a foot portion for engagement with the annular wall for correct positioning of the at least one leg in such pivoted disposition.

A pair of spaced-apart legs may advantageously be utilized. For example, in a contemplated embodiment, the base may be predominantly round and the annular wall may be predominantly curvilinear with a segment of the annular wall being substantially linear. In such embodiment, the legs may advantageously be formed along the linear segment of the annular wall.

It is further contemplated that the annular wall of the base may taper narrowingly from the rim to the bottom wall to enable receipt of the bottom wall and the annular wall within the containment area of a second like base, thereby to facilitate nesting of multiple like bases. Similarly, an outer side of the lid may be formed with a recessed annular shoulder for receipt of the annular flange of a second like lid, thereby to facilitate nesting of multiple like lids.

If desired, either or both of the base and the lid may be formed with a projecting tab formed with an opening to allow the container to be hung and displayed from a hanger device, in circumstances where retail display shelving may not be used or available.

DETAILED DESCRIPTION OF THE PREFERRED EMBODIMENTS

Figure 1:
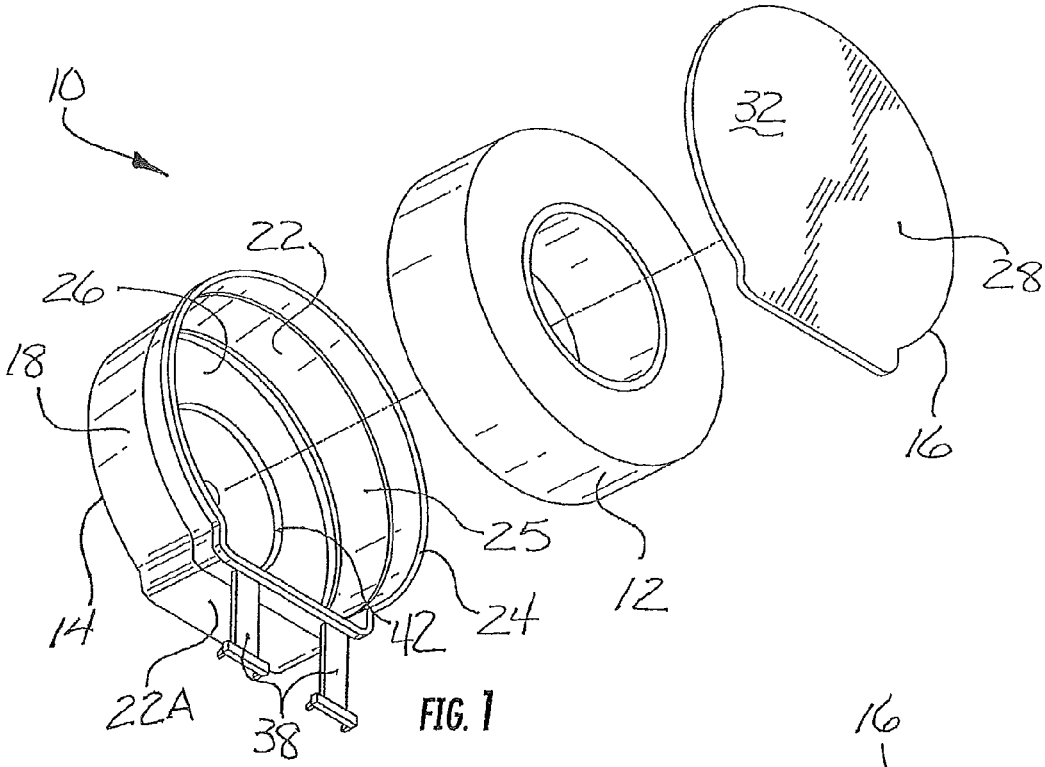
FIG. 1 is a front exploded perspective view of a retail product display container according to the present invention.
Figure 2:
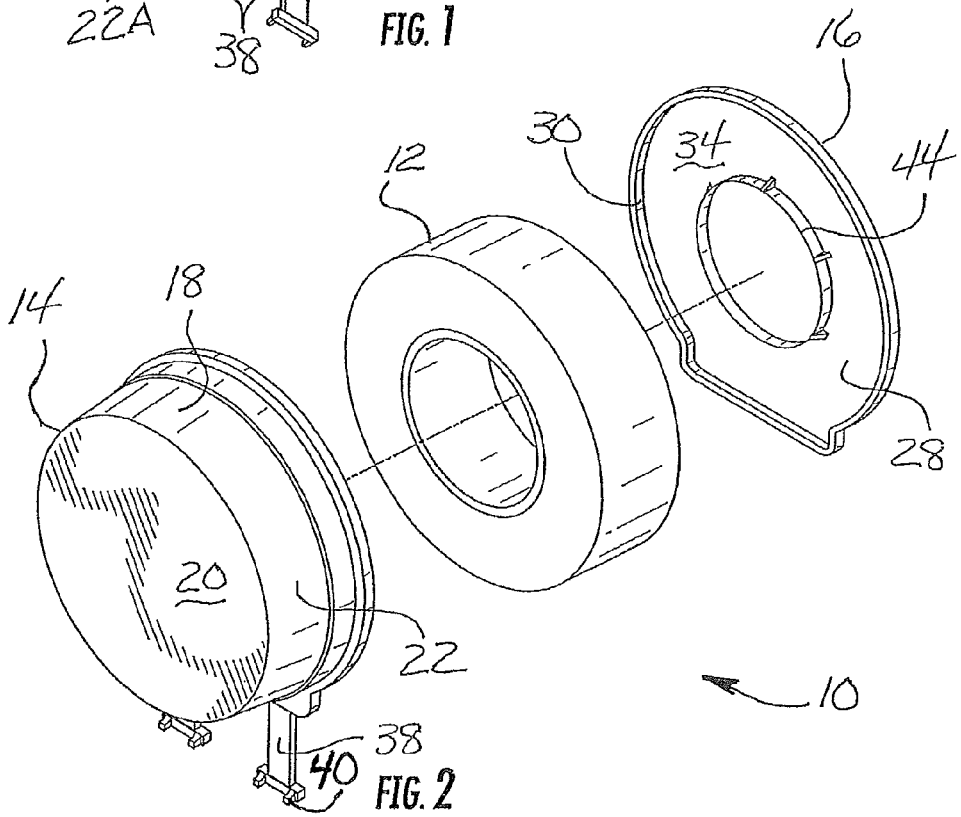
FIG. 2 is a rear exploded perspective view of the retail product display container of FIG. 1.

Referring now to the accompanying drawings and initially to FIGS. 1 and 2, a retail product display container according to the present invention is depicted generally at 10 in one representative contemplated embodiment adapted for packaging a roll of adhesive tape, e.g., a roll of painter's masking tape represented at 12. However, it is to be expressly understood that the container of the present invention is contemplated to be adapted to any of a wide number of differing shapes, sizes and configurations for use in packaging any of a correspondingly wide diversity of differing products. The embodiment of the container 10 illustrated and described herein is presented merely as one contemplated example in order to provide an enabling disclosure and understanding of the basic structure, concepts and features of the present invention, and is not intended nor to be construed as a limitation of any sort on the scope and substance of the present invention.

The container 10 basically comprises a base component 14 and a lid component 16 mated to one another. With additional reference to FIGS. 3 and 4, the base 14 has a bowl-shaped body 18 having a bottom wall 20 merging into an outer annular wall 22 projecting from the perimeter of the bottom wall 20 and terminating at a free annular edge 24 forming an annular rim to the base 14. The bottom and outer annular walls 20, 22 define an interior containment area 26 with the rim formed by the free annular edge 24 defining an opening 25 into the containment area 26. The containment area 26 is sized and configured in close conformity to the roll of tape 12 in order to receive the roll of tape 12 with minimal unoccupied space in the containment area 26. Thus, the bowl-shaped body 18 of the base 14 is predominantly circular in configuration, with the bottom wall 20 being substantially flat and predominantly circular, and with the annular wall 22 correspondingly being predominantly circular but slightly tapered as more fully explained below.

Figure 6:
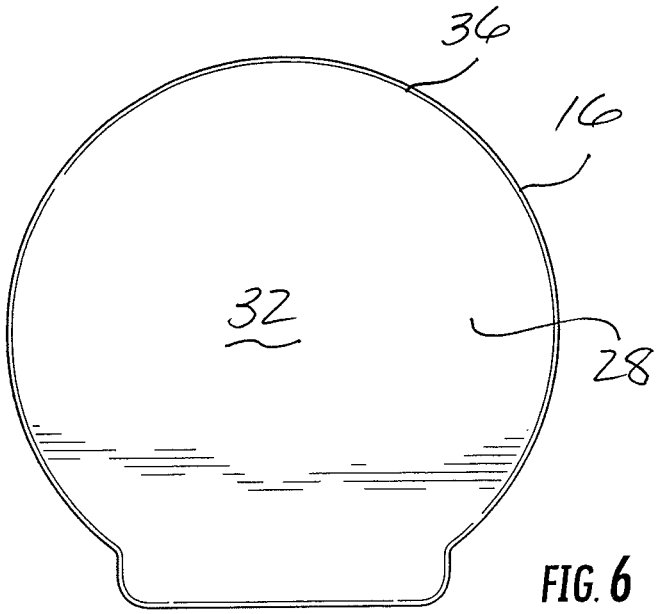
FIG. 6 is a rear elevational view of the lid component of the retail product display container of FIGS. 1 and 2.
Figure 7:
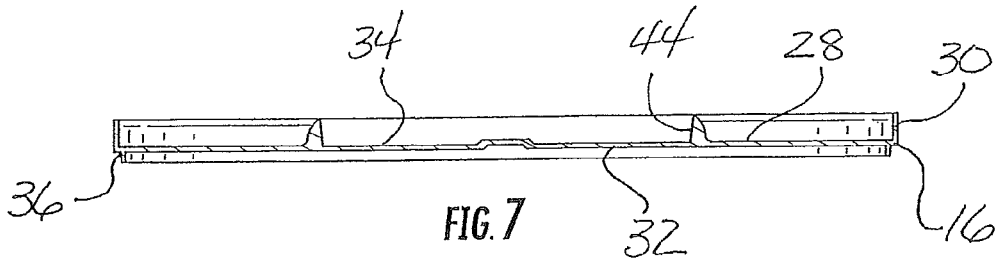
FIG. 7 is a vertical cross-sectional view of the lid component of FIG. 6.

With additional reference to FIGS. 6 and 7 of the drawings, the lid 16 is configured correspondingly to the base 14 and, thereby, has a main body 28 of a generally flat and predominantly circular configuration defining an outer side 32 and an inner side 34, with an annular flange 30 projecting generally axially from the inner side 34 at the perimeter of the main body 28. Accordingly, the lid 16 is adapted to be placed over the opening 25 of the base 14 and the flange 30 frictionally engaged outwardly about the free annular edge 24 of annular wall 22, thereby to secure the lid 16 on the base 14. In such manner, the lid 16 may be selectively attached to and detached from the rim of the free annular edge 24 of the base 14 to selectively open and close access into the containment area 26.

Figure 3:
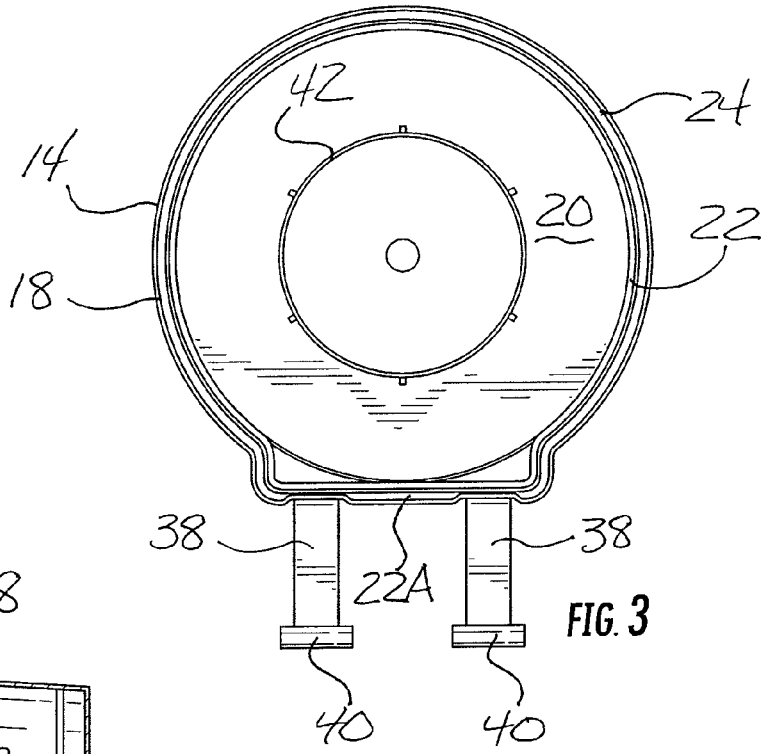
FIG. 3 is a front elevational view of the base component of the retail product display container of FIGS. 1 and 2.
Figure 4:
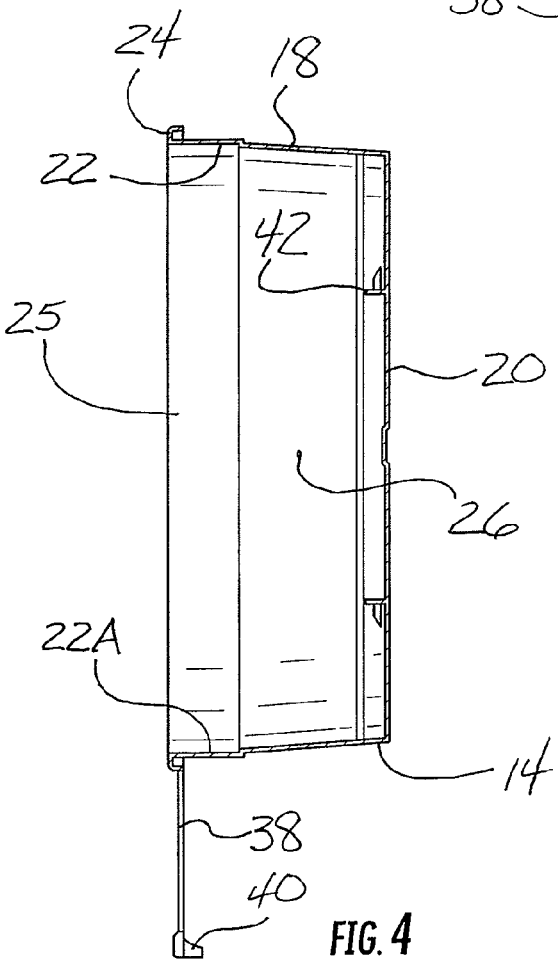
FIG. 4 is a vertical cross-sectional view of the base component of FIG. 3.

As shown in FIGS. 3 and 6, the interior surface of the bottom wall 20 of the base 14 and the inner side 34 of the lid 16 may be formed with ring portions 42, 44, respectively, to matingly extend into the inner core of the roll of tape 12 to further assist in holding the roll of tape securely within the containment area 26.

According to one feature of the present invention, each of the base 14 and the lid 16 are adapted to be conveniently and compactly nested with a plurality of other like base and lid components, so as to best facilitate shipment and storage of the components prior to assembly. Accordingly, the annular wall 22 of the base 14, as previously indicated, is tapered to narrow in steps from its largest diametric dimension at its free annular edge 24 to its smallest dimension at its juncture with the bottom wall 20, which facilitates the insertion and receipt of the bottom wall 20 and the annular wall 22 of one base component into and within the containment area 26 of a second like base component, as representatively depicted for a plurality of base components in FIG. 5 of the drawings.

Figure 8:
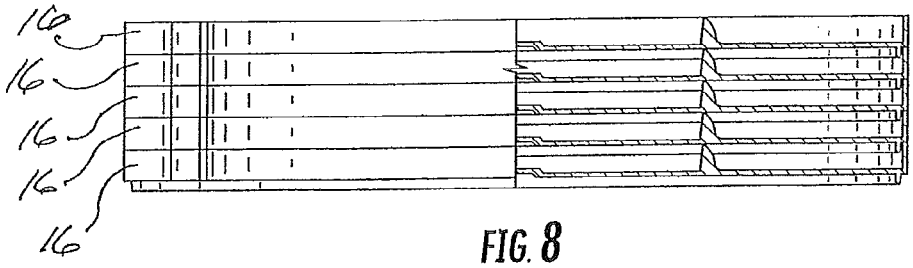
FIG. 8 is a view, partially in side elevation and partially in vertical cross-section, of a plurality of the lid components of FIGS. 6 and 7 in nested engagement with one another.

Similarly, the outer side 32 of the main body 28 of the lid 16 is formed adjacent the perimeter of the main body 28 with a recessed annular shoulder 36 opposite the projecting flange 30. Accordingly, the lid 16 is adapted to be conveniently and compactly nested in a stacked arrangement with another like lid 16 with the annular flange 30 of one lid 16 received within and resting on the annular shoulder 36 of the other lid 16, as representatively depicted for a plurality of lid components in FIG. 8 of the drawings.

Figure 5:
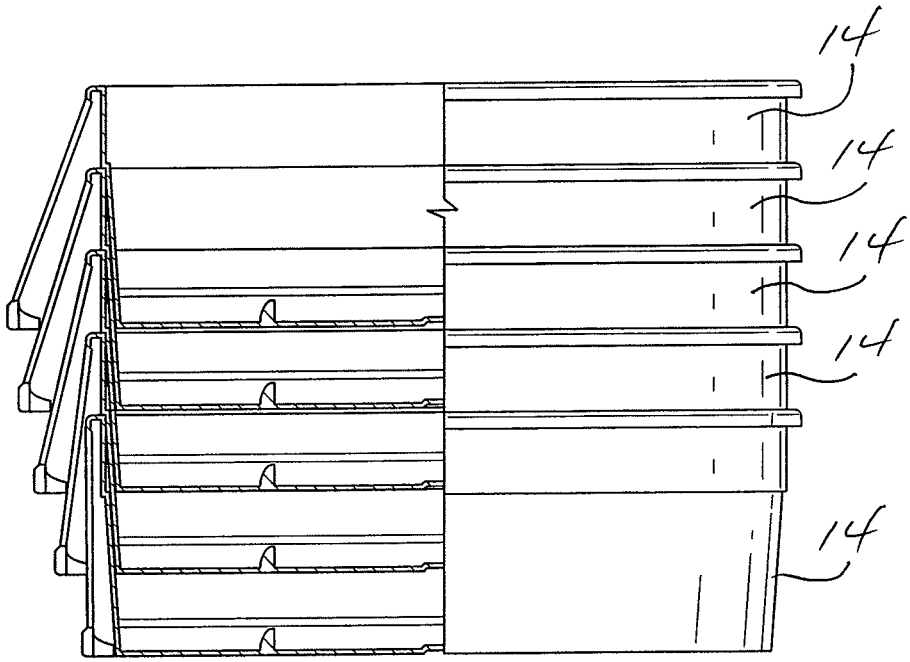
FIG. 5 is a view, partially in side elevation and partially in vertical cross-section, of a plurality of the base components of FIGS. 3 and 4 in nested engagement with one another.
Figure 9:
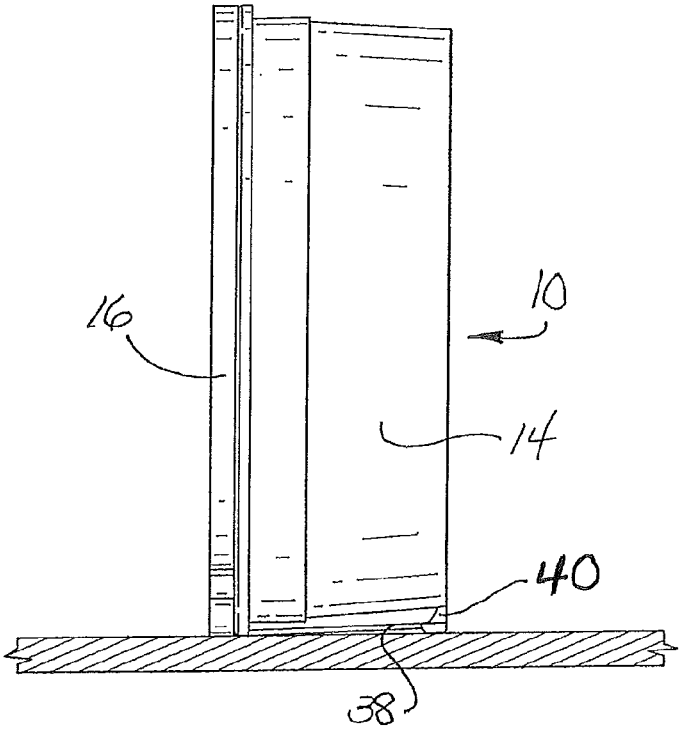
FIG. 9 is a side elevational view of the retail product display container of FIGS. 1 and 2, with the base and lid components fully assembled with one another.

According to another feature of the present invention, the assembled container 10 is adapted for self-standing on a horizontal support surface, such as a retail store shelf, despite the substantially round and tapered configuration of the bowl-shaped body 18 of the base 14. For this purpose, at least one leg component 38 is connected outwardly to the annular wall 22 of the base 14 adjacent the rim defined by the free annular edge 24 to provide self-standing support for the assembled container. More preferably, a pair of legs 38 are provided in space-apart relationship on the annular wall 22. As seen in FIG. 6, while the base 14 is predominantly round and the annular wall 22 is predominantly curvilinear, a segment 22A of the annular wall 22 is substantially linear, with the two legs 38 disposed in spaced relation adjacent opposite ends of the linear segment 22A. The legs 38 are preferably molded integrally with the annular wall segment 22A in the form of a so-called "living hinge" permitting the legs 38 to pivot relative to the annular wall segment 22A between a position projecting outwardly therefrom to a position extending closely along the wall segment 22A. The terminal free end of each leg 38 has a foot portion 40 configured to engage with the wall segment 22A when the leg 38 is pivoted toward the wall segment 22A. The foot portions 40 of the legs 38 thereby ensure that the legs 38 extend substantially precisely axially relative to the assembled base 14 and lid 16 of the container 10 so as to support the container 10 in a substantially vertical orientation when standing on a substantially horizontal surface, such as a retail shelf, as representatively depicted in FIG. 9. Similarly, the legs 38 are pivotable in similar manner when the base 14 is nested with other like bases 14, as depicted in FIG. 5, thereby to further facilitate compact nested storage and shipment.

Although the legs 38 on the base 14 facilitate self-standing of the container 10 for retail display in the manner above-described, it is also recognized that some retail establishments may not have shelf space to display the containers 10 or may prefer to display the containers 10 via a hanger-type display. Accordingly, in order to provide retailers with greater flexibility, it is contemplated that the lid 16, or the base 14, or both, may be formed with a hanger tab (not shown) with an opening therethrough to facilitate placement on a hanger bar or the like, preferably with the hanger tab being disposed diametrically opposite the legs 38. These and other modifications and adaptations are within the scope and contemplation of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A container for packaging a product for retail display, the container comprising a base defining a product containment area with an annular rim defining an opening into the containment area and a lid mated to the rim for selective attachment to and detachment from the rim for opening and closing access into the containment area, and a pair of spaced-apart legs connected outwardly to the base adjacent the rim for supporting the assembled base and lid for self-standing on a substantially horizontal retail display surface with the base and the lid in a substantially vertical orientation, wherein the base is bowl-shaped with a bottom wall and an annular wall projecting from the bottom wall, and with the rim formed along a free annular edge of the annular wall, the lid comprising an inner side formed with an annular flange for frictional engagement about the rim of the base to secure the lid on the base, the legs being pivoted to the base adjacent the rim to be engaged by the flange of the lid when mated to the rim of the base for pivoting the legs into disposition for supporting the base and lid in said self-standing orientation when the lid is secured to the base, the base being predominantly round and the annular wall being predominantly curvilinear with a segment of the annular wall being substantially linear, the legs being formed along the linear segment of the annular wall.

2. A container for packaging a product for retail display according to claim 1, wherein the annular wall of the base tapers narrowingly from the rim to the bottom wall for receipt of the bottom wall and the annular wall within the containment area of a second like base, thereby to facilitate nesting of multiple like bases.

3. A container for packaging a product for retail display according to claim 1, wherein the lid has an outer side formed with a recessed annular shoulder for receipt of the annular flange of a second like lid, thereby to facilitate nesting of multiple like lids.

4. A container for packaging a product for retail display according to claim 1, wherein the pair of spaced apart legs includes a foot portion for engagement with the annular wall for positioning of the legs in said pivoted disposition.

5. A container for packaging a product for retail display according to claim 1, wherein the base is configured to nest with like bases.

6. A container for packaging a product for retail display according to claim 1, wherein the lid is configured to nest with like lids.

* * * * *